United States Patent [19]

Oswald

[11] 4,445,435

[45] May 1, 1984

[54] ELECTRONIC DELAY BLASTING CIRCUIT

[75] Inventor: Gerald L. Oswald, New Ringgold, Pa.

[73] Assignee: Atlas Powder Company, Dallas, Tex.

[21] Appl. No.: 357,483

[22] Filed: Mar. 12, 1982

Related U.S. Application Data

[63] Continuation-in-part of Ser. No. 146,192, May 5, 1980, Pat. No. 4,328,751.

[51] Int. Cl.[3] ..... F42C 11/06

[52] U.S. Cl. ..... 102/215; 102/206; 102/220

[58] Field of Search ..... 102/215, 220, 217, 206, 102/200; 361/251

[56] References Cited

U.S. PATENT DOCUMENTS

| | | | |
|---|---|---|---|
| 3,206,612 | 9/1965 | Swanekamp et al. | 307/252 |
| 3,306,208 | 2/1967 | Bergey et al. | 102/217 |
| 3,312,869 | 4/1967 | Werner | 102/217 |
| 3,316,451 | 4/1967 | Silberman | 102/217 |
| 3,343,493 | 9/1967 | Aulds et al. | 102/220 |
| 3,424,924 | 1/1969 | Leisinger et al. | 102/217 |
| 3,500,746 | 3/1970 | Ambrosini | 102/215 |
| 3,610,153 | 10/1971 | Betts et al. | 102/220 |
| 3,618,519 | 11/1971 | Griffith | 102/217 |
| 3,618,525 | 11/1971 | Fritz | 102/220 |
| 3,631,802 | 1/1972 | Lawrence | 102/202.11 |
| 3,640,224 | 2/1972 | Petrick et al. | 102/220 |
| 3,653,324 | 4/1972 | Furlani et al. | 102/215 |
| 3,736,837 | 6/1973 | Kaprelian et al. | 102/219 |
| 3,762,331 | 10/1973 | Vlahos | 102/218 |
| 3,787,740 | 1/1974 | Salton et al. | 102/220 |
| 3,788,228 | 1/1974 | Wilson | 102/220 |
| 3,834,310 | 9/1974 | Veda et al. | 102/220 |
| 3,838,206 | 9/1974 | Eklund | 102/202.5 |
| 3,851,589 | 12/1974 | Meyer | 102/215 |
| 3,878,786 | 4/1975 | Ridgeway | 102/202.11 |
| 3,971,320 | 7/1976 | Lee | 102/202.9 |
| 3,988,989 | 11/1976 | Shea | 102/202.14 |
| 4,088,075 | 5/1978 | Hayman | 102/427 |
| 4,145,970 | 3/1979 | Hedberg et al. | 102/206 |
| 4,227,461 | 10/1980 | Beezley et al. | 102/218 |
| 4,239,004 | 12/1980 | Day et al. | 102/202.13 |
| 4,311,096 | 1/1982 | Oswald | 102/220 |
| 4,324,182 | 4/1982 | Kirby et al. | 102/215 |
| 4,328,751 | 5/1982 | Oswald | 102/220 |

FOREIGN PATENT DOCUMENTS

| | | |
|---|---|---|
| 3412 | 8/1979 | European Pat. Off. . |
| 1319857 | 6/1973 | United Kingdom . |
| 1526634 | 9/1978 | United Kingdom . |

*Primary Examiner*—Charles T. Jordan

*Attorney, Agent, or Firm*—Richards, Harris & Medlock

[57] ABSTRACT

An electronic delay blasting circuit (100) receives an input signal through input lines (102, 104). The input signal is passed through a rectifier (106) to produce a DC signal for storing charge on capacitors (140, 152). The capacitor (152) serves as a power supply for a digital counting circuit. The capacitor (140) serves to store electrical energy for firing an electric match ignition element (174). A plurality of switches (200, 202, 244, 246, 248, 250 and 252) are set to a reference count to determine the delay period of the circuit (100). When the input signal is terminated, counter circuits (196, 198) are initiated to count the clock output of an oscillator (208). When the sequential count from the counters (196, 198) equals the stored reference count, an SCR (176) is triggered to apply the stored electrical charge from capacitor (140) to the electric match ignition element (174). The oscillator (208) includes a crystal (214) to insure that the digital count and resulting time delay of the blasting circuit (100) are accurate and reliable.

2 Claims, 4 Drawing Figures

ELECTRONIC DELAY BLASTING CIRCUIT

This application is a continuation-in-part of application Ser. No. 146,192 filed May 5, 1980, now U.S. Pat. No. 4,328,751.

TECHNICAL FIELD

The present invention pertains in general to an electronic circuit and more particularly to such a circuit for firing a blasting cap following a preset delay.

BACKGROUND ART

In most blasting operations, efficient use of explosive energy includes obtaining the desired breakage and movement of ore and rock. It is also becoming increasingly important to minimize the effects of blasting on nearby structures by maintaining close control over ground vibrations produced by the blast. In a multi-hole blasting pattern, it is usually desirable not to have all of the explosives detonate at one time, but to separate the detonation of each hole by at least eight milliseconds in time to control ground vibrations. The separation of the total weight of explosives used in a blast into smaller charges detonated individually in time sequence is achieved by means of delay blasting. Delay blasting normally involves the use of electric or nonelectric delay blasting caps, detonating cord delay connectors or blasting machines of the sequential type.

All presently manufactured electric and nonelectric delay blasting caps have internal delay elements which are based upon the timed burning of pyrotechnic mixtures compressed into metal tubes. The delay timing is achieved by the ignition and burning of the pyrotechnic mixture.

The problem with pyrotechnic delay blasting caps is that, even under the most careful manufacturing conditions, the delay timing of any given delay period is subject to inherent time scatter due to the nature of the burning process. Therefore, the exact detonation time of the blasting cap cannot be controlled with high precision. Because of time scatter, it is possible for pyrotechnic delay blasting caps of two adjoining delay periods to detonate so close together in time that an undesirable level of ground vibration is produced since more than the optimum weight of explosives is detonated at the same time.

The sequential type blasting machines provide controlled timing electric pulses to electric blasting caps. These timing pulses are formed by electronic means and are precise. However, during blasting, circuit wires between the blasting machine and the electric blasting caps must be maintained intact until the blasting caps receive the firing pulses from the machine. Therefore, it has been found that sequential switches must be used in conjunction with pyrotechnic delay electric blasting caps placed in the boreholes to minimize the premature breaking or shorting of circuit wires. Problems with control of vibrations, therefore, are the same as with the aforementioned use of pyrotechnic delay electric blasting caps.

Unless the sequential blast is designed to have all caps ignited before the first hole detonates, the possibility for broken or shorted circuit wires is increased. Many sequential blasting patterns do not permit all caps to be ignited before hole detonation begins.

In many cases, sequential blasting machine patterns are designed so that there are only eight milliseconds between detonations. It can be seen that the normal scatter in pyrotechnical delays will result in detonations at less than eight millisecond intervals and will increase the probability of out of sequence detonations. When this occurs, ground vibrations may be increased and rock fragmentation may be poor.

Because pyrotechnic delay blasting caps must be used with sequential blasting machines, problems with vibration control and rock fragmentations are the same as with the aforementioned use of delay electric blasting caps.

As explained previously, standard delay blasting involves detonating individual explosive columns at predetermined time intervals. During this process, boreholes that detonate at later delay intervals are subjected to shock and gas pressures generated from the detonation of explosives in adjoining boreholes. Blasting caps are required to withstand these pressures and must function properly at the desired delay interval.

The component parts of an electric blasting system include the blasting machine, firing line, connecting wires, and electric blasting caps.

Electric blasting caps are commonly fired from capacitor discharge type blasting machines. These power sources utilize an energy storage capacitor that is charged to a high voltage such as 450 VDC. Upon activation of a firing switch, the energy is released to the blasting caps through a firing line and connecting wires. Low resistance, heavy gauge copper firing lines and connecting wires are commonly used to minimize energy losses.

Blasting circuits are laid out in series, parallel, or parallel series combinations to permit efficient use of available electrical energy. To assure that the energy is distributed properly, blasting personnel are required to optimize the blasting circuit design by performing energy calculations, which often become difficult and complex. The resistance balancing of parallel branches is also necessary for optimum energy distribution. In the event that the available energy is not distributed properly, and a blasting cap fails to fire because of insufficient current, undetonated explosives will remain in the muckpile resulting in a very hazardous condition.

Many mining and construction companies have difficulty in hiring qualified blasters, and in many cases the turnover of personnel is very high. The frequent training of new blasters, although very important, becomes very costly and time consuming. Therefore, simplification of electric blasting would be advantageous from both a training and the aforementioned safety standpoints.

The high voltage from a standard blasting machine poses either a possible shock hazard condition to blasting personnel or a problem of current leakage from damaged insulation or bare wire connections. A lower voltage electric blasting system would not present a shock hazard, and would be far less susceptible to current leakage, thus, reducing the possibility of misfires.

Electric blasting caps can be fired from a $1\frac{1}{2}$ volt flashlight cell. It would be desirable to increase this voltage requirement to reduce the susceptibility of the cap to be prematurely initiated by extraneous electricity.

In summary, the need for precise delay timing can be clearly justified by improving rock fragmentation and reducing undesirable levels of ground vibration. Also, improving the safety of electric blasting systems is a continuing goal for companies associated with explosives. Reliability, susceptibility to extraneous electricity and simplification of firing systems are all vital areas for safety improvement considerations.

DISCLOSURE OF THE INVENTION

A selected embodiment of the present invention is a blasting circuit for firing an ignition element following a time delay. The blasting circuit includes circuit means for storing an electrical charge and circuit means for receiving an input signal to provide electrical energy therefrom for storage in the circuit means for storing. Circuitry is provided for storing a digital reference count to determine the duration of the time delay. Circuit means responsive to an amplitude transition of the input signal is provided for generating an initiating signal. Digital timing circuitry is connected to receive the digital reference count and the initiating signal for generating an ignition signal at the expiration of the period of the time delay following receipt of the initiating signal. Further circuit means are provided which are responsive to the ignition signal for connecting the circuit means storing electrical charge to the ignition element to cause the firing of the ignition element.

BRIEF DESCRIPTION OF THE DRAWINGS

For a more complete understanding of the present invention and the advantages thereof, reference is now made to the following description taken in conjunction with the accompanying drawings in which.

DETAILED DESCRIPTION OF THE INVENTION

Figure 1:
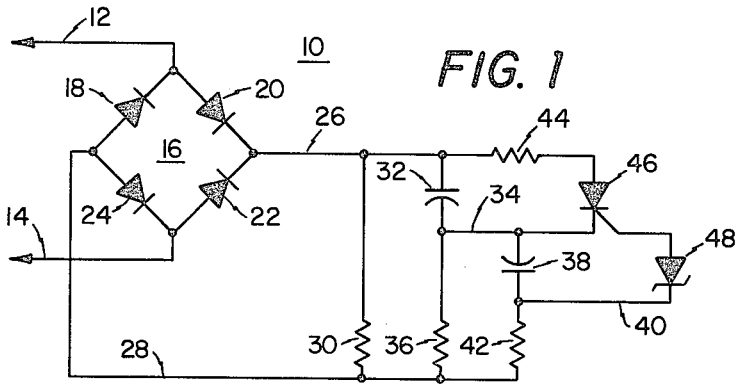
FIG. 1 is a schematic diagram illustrating a delay blasting circuit in accordance with the present invention.

In the following descriptive material, like reference numerals refer to like components in the various views.

Referring to FIG. 1, an electronic delay blasting circuit 10 is connected to receive an input charging signal through leg wires 12 and 14. The input charging signal is preferably a DC signal at twelve, twenty-four or forty-eight volts. The input charging signal can, however, be AC. The leg wires 12 and 14 are connected to the input terminals of a full-wave rectifier 16. Rectifier 16 is a diode bridge comprising diodes 18, 20, 22 and 24. The output terminals of rectifier 16 are connected to lines 26 and 28.

A resistor 30 has a first terminal thereof connected to line 26 and a second terminal thereof connected to line 28.

A capacitor 32 is connected between line 26 and a node 34. A resistor 36 is connected between node 34 and line 28. Resistor 36 is connected in series with capacitor 32 between lines 26 and 28.

A capacitor 38 is connected between node 34 and a second node 40. A resistor 42 is connected between node 40 and line 28. Resistor 42 is connected in series with capacitor 38 between node 34 and line 28.

A resistive ignition element 44, such as a resistance wire, has a first terminal thereof connected to line 26 and a second terminal thereof connected to the anode terminal of a silicon controlled rectifier (SCR) 46. The cathode terminal of SCR 46 is connected to node 34. The gate terminal of SCR 46 is connected to the anode terminal of a zener diode 48. The cathode terminal of zener diode 48 is connected to node 40.

The operation of electronic delay blasting circuit 10 is now described in reference to FIG. 1. Circuit 10 is fabricated to be an integral part of a blasting cap (not shown) which serves to ignite a primary charge. As noted above, heavy gauge wire and a high energy power source have heretofore been required for the activation of a plurality of electric blasting caps. The circuit of the present invention, however, permits the firing of a plurality of blasting caps and requires only a small gauge firing line and a low energy power source.

The input signal, either AC or DC, to circuit 10 is provided through leg wires 12 and 14 to the fullwave rectifier 16. The output of rectifier 16 is a DC signal between lines 26 and 28 in which line 26 is the more positive relative to line 28.

The DC signal produced by rectifier 16 is applied directly to resistor 30 and to capacitor 32 through resistor 36. Capacitor 32 is charged by the DC signal and the rate of charge is dependent upon its capacitance, the resistance of resistor 36, the impedance of diodes 18–24 and the internal resistance of the energy source (not shown) which supplies the input signal to the leg wires 12 and 14. After a period of time, capacitor 32 will become charged to the peak level of the DC voltage produced by rectifier 16.

During the charging of capacitor 32, a current will flow through resistor 36 which will produce a voltage across the series combination of resistor 42 and capacitor 38. This will produce a temporary charge on capacitor 38 which will tend to apply a negative bias to the gate terminal of SCR 46. Since SCR 46 is in the off state at this time the voltage across capacitor 38 has no effect on SCR 46 during the charging of capacitor 32. After capacitor 32 has reached its full charge, capacitor 38 will discharge through resistors 36 and 42.

After capacitor 32 has reached a full charge provided by the DC signal produced by rectifier 16, circuit 10 will be in the quiescent state. Current will continue to flow through resistor 30 but the current flow through the remainder of the circuit will be minute. When the capacitor 32 is charged to approximately the peak value of the input signal provided on lines 12 and 14, circuit 10 is armed and in the ready to fire condition.

Upon removal of the input signal from lines 12 and 14, which constitutes a sudden transition reducing the amplitude of the input signal, the delay elements of circuit 10 are activated. Storage capacitor 32 now becomes the source of energy for circuit 10. Current flow is established through resistors 30 and 36 which produces a voltage differential across resistor 36 that in turn produces a current flow through the series combination of resistor 42 and capacitor 38. For a period of time the voltage across capacitor 38 will increase continuously until the voltage on the capacitor is equal to the threshold, reference, voltage of zener diode 48. When the voltage on capacitor 38 reaches this threshold voltage, zener diode 48 will be reversed biased and a positive voltage will be applied to the gate terminal of SCR 46. The positive potential on the gate terminal causes SCR 46 to become conductive which in turn connects the resistive ignition element 44 directly across the terminals of capacitor 32. A substantial portion of the remaining charge on capacitor 32 is applied to element 44 and is sufficient to cause the element to ignite. This in turn causes detonation of the blasting cap containing circuit 10.

The time delay between the removal of the input signal and the firing of element 44 is determined by resistors 30, 36 and 42 together with the capacitance of capacitors 32 and 38. The most direct method, however, for setting the time delay of circuit 10 is to adjust the values of resistor 42 and capacitor 38.

An important aspect of the electronic delay blasting cap is that once the unit is armed by an input signal, the circuit will function normally even if the external firing line or leg wires become broken or short circuited during the blast. The rectifier 16 is used to isolate the armed circuit from the external circuit to prevent the external circuit from affecting the timing operation and to prevent the stored energy from bleeding back into the input wires. The rectifier 16 also permits firing line connections to be made without regard to polarity. Also, the reliability of the blasting operation is substantially increased by storing electrical energy in a capacitor which is a component part of each electronic delay blasting cap. This permits all of the caps in a blasting pattern to be armed and self-operating before the first hole detonates. Therefore, the problems associated with breaking or shorting of circuit wires, due to burden or surface movement in a blast, are eliminated. In addition, the delay time of an electronic delay blasting cap as described herein is extremely accurate and precise when compared to conventional delay blasting caps using pyrotechnic mixtures for delay timing.

A design example for the circuit shown in FIG. 1 is provided with the values shown in Table 1.

Input Signal=24 Volts DC
Resistor 30=2K Ohms, $\frac{1}{8}$ Watt
Resistor 36=10K Ohms, $\frac{1}{8}$ Watt
Resistor 42=100K Ohms, $\frac{1}{8}$ Watt
Capacitor 32=100 Microfarads, 25 VDC
Capacitor 38=1 Microfarad, 12 VDC
Zener Diode 48=12 Volts, $\frac{1}{2}$ Watt-Sylvania ECG-5021
SCR 46=0.8 Amps-Sylvania ECG-5400
Ignition Element 44=Instantaneous Electric Blasting Cap
Delay Period=141 Milliseconds (±1 Millisecond)

TABLE I

A plurality of electronic blasting caps utilizing the circuit shown in FIG. 1 have been tested when connected in straight parallel. The blasting caps were activated successfully with approximately the same delay time.

Figure 2:
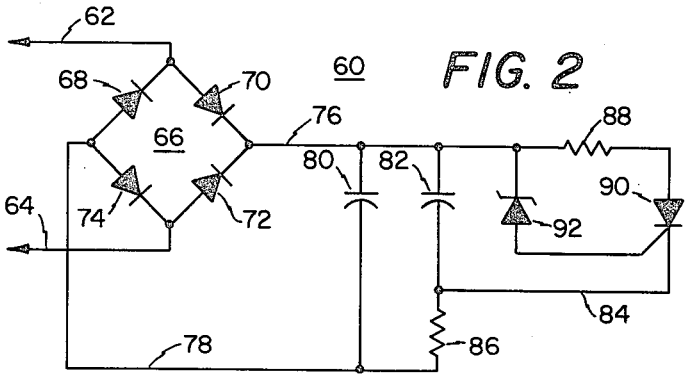
FIG. 2 is a schematic diagram illustrating an alternative embodiment of a delay blasting circuit in accordance with the present invention.

A further embodiment of the present invention is illustrated in FIG. 2. Electronic delay blasting circuit 60, which is fabricated to be an integral part of a blasting cap, receives an input signal over leg wires 62 and 64 which are connected to the input terminals of a full-wave rectifier 66. A plurality of diodes 68, 70, 72 and 74 are connected in a bridge arrangement to form rectifier 66. The output terminals of rectifier 66 are connected to lines 76 and 78. Rectifier 66 produces a DC signal output on lines 76 and 78 with line 76 positive relative to line 78.

An energy storage capacitor 80 has a first terminal thereof connected to line 76 and a second terminal thereof connected to line 78.

A capacitor 82 has a first terminal connected to line 76 and a second terminal connected to a node 84. A resistor 86 is connected between node 84 and line 78.

A resistive ignition element 88 has a first terminal connected to line 76 and a second terminal connected to the anode terminal of an SCR 90. The cathode terminal of SCR 90 is connected to node 84.

A zener diode 92 has the anode terminal thereof connected to the gate terminal of SCR 90 and the cathode terminal thereof connected to line 76.

The electronic firing circuit 60 functions in a different manner from that of circuit 10 shown in FIG. 1 The time delay period of circuit 60 begins upon the application of the input signal. When the input signal transitions from a zero level to its full potential, a current pulse is applied through leg wires 62 and 64 to the rectifier 66. This current pulse produces a DC signal at the output of rectifier 66 between line 76 and 78. The DC signal resulting from the current pulse starts to immediately charge capacitor 80 while charging capacitor 82 through resistor 86. After the initial transition of the input pulse, the voltage on capacitor 82 will continuously increase until it reaches the threshold voltage of zener diode 92. When the threshold is reached, the zener diode 92 will become conductive and the gate terminal of SCR 90 will have a positive voltage applied thereto. A positive voltage on the gate terminal of SCR 90 causes the SCR to become conductive and connect the ignition element 88 directly between line 76 and node 84. The energy stored on capacitors 80 and 82 will then be directed through the ignition element 88 to cause ignition thereof.

The time delay of circuit 60 is controlled by the charging of capacitor 82 and this is primarily determined by the resistance value of resistor 86.

The use of circuit 60 in place of circuit 10 provides an advantage in the case where an open or short should occur in the firing circuit before the storage capacitor in circuit 10 is fully charged. When this occurs the time delay for the blast does not occur on schedule. But with the circuit 60 the time period is initiated at the start of the input signal. The circuit 60, however, requires the use of heavy gauge, low resistance firing line and a high energy firing source in order to fire a substantial number of caps in a single blast.

A further advantage of circuit 60 is that it utilizes fewer components than circuit 10. By having fewer components circuit 60 is less expensive and is also more reliable since there are fewer circuit elements subject to failure.

Figure 3:
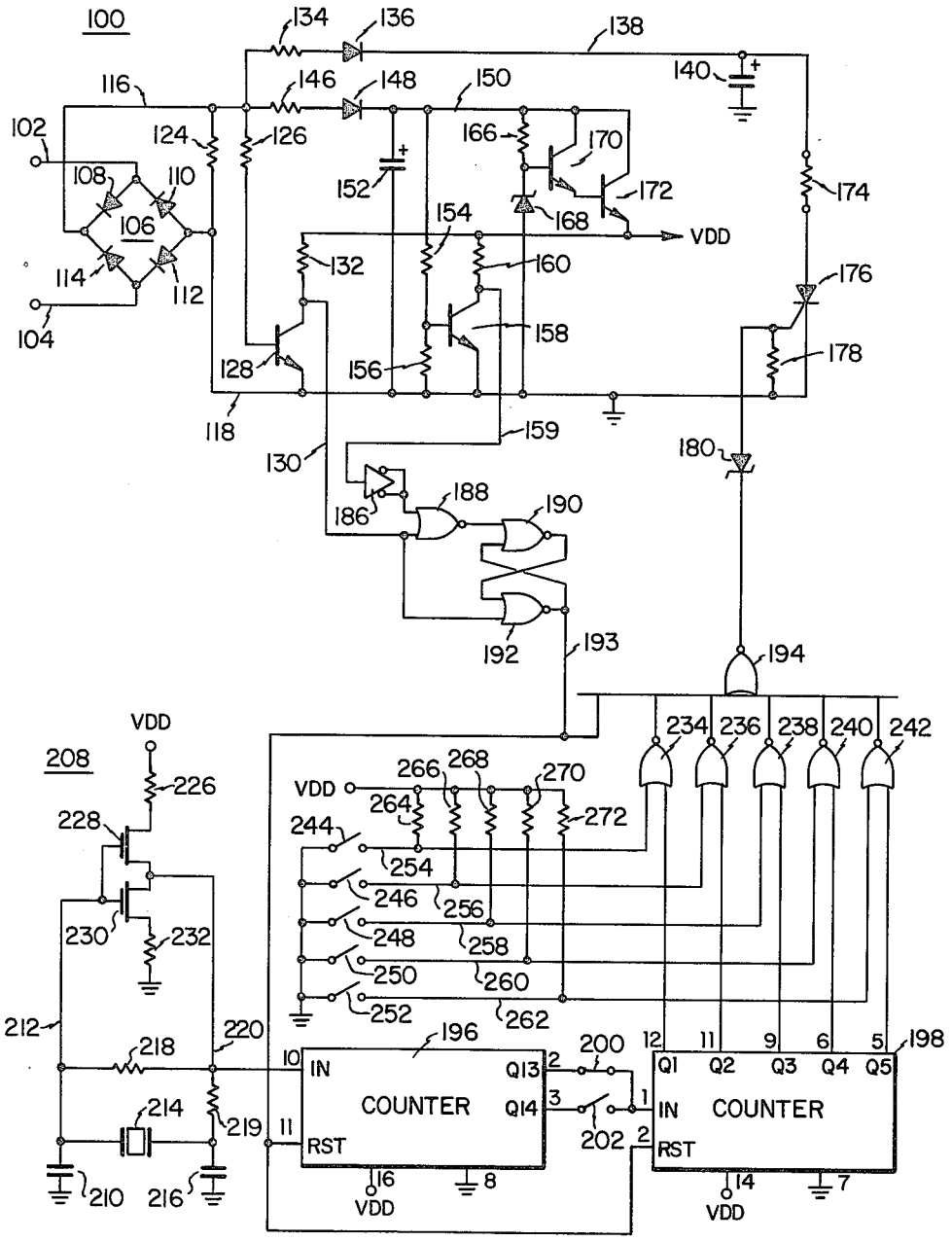
FIG. 3 is a schematic diagram illustrating a further embodiment of the present invention which includes a digital timing circuit.

A still further embodiment of the present invention is illustrated in FIG. 3 as a delay blasting circuit 100. The circuit 100 utilizes an oscillator and digital counting circuitry to perform the timing function in place of the RC timing elements used in the delay circuits 10 and 60 described above.

Circuit 100 has input lines 102 and 104 for receiving an input signal which is preferably a DC signal in the range of thirty-two to forty-eight volts. The input signal is provided to a full-wave rectifier 106 which comprises diodes 108, 110, 112 and 114. The DC output of the full-wave rectifier 106 is taken at nodes 116 and 118. Node 118 is defined as the circuit ground.

A resistor 124 is connected between nodes 116 and 118.

A resistor 126 is connected between node 116 and the base terminal of an NPN transistor 128. The emitter terminal of transistor 128 is connected to node 118. The collector terminal of transistor 128 is connected to a node 130. A resistor 132 is connected between node 130 and a terminal labeled VDD which serves as a power supply for other components in circuit 100.

A resistor 134 is connected between node 116 and the anode terminal of a diode 136. The cathode terminal of diode 136 is connected to a node 138. A capacitor 140 is connected between node 138 and the circuit ground. A resistor 146 is connected between node 116 and the anode terminal of a diode 148. The cathode terminal of diode 148 is connected to a node 150.

A capacitor 152 is connected between node 150 and the ground node 118.

A series pair of resistors 154 and 156 are connected between node 150 and the circuit ground. An NPN transistor 158 has its base terminal connected to the junction of resistors 154 and 156. The collector terminal of transistor 158 is connected to a node 159. A resistor 160 is connected between node 159 and the power node VDD.

A resistor 166 is connected between node 150 and the cathode terminal of a zener diode 168. The anode terminal of zener diode 168 is connected to the circuit ground.

An NPN transistor 170 has its base terminal connected to the junction of resistor 166 and zener diode 168, its collector terminal connected to node 150 and its emitter terminal connected to the base terminal of an NPN transistor 172. The transistor 172 has its collector terminal connected to node 150 and its emitter terminal connected to the node VDD.

A resistive electric match 174, an ignition element, is connected between node 138 and the anode of a silicon controlled rectifier (SCR) 176. The cathode of SCR 176 is connected to the circuit ground. A resistor 178 is connected between the gate terminal of SCR 176 and ground. A zener diode 180 has the anode terminal thereof connected to the gate terminal of SCR 176.

An inverter 186 has its input connected to the collector terminal of transistor 158 through node 159. The outputs of inverter 186 are connected to a first input of a NOR gate 188. The second input to gate 188 is connected to node 130. A pair of NOR gates 190 and 192 are connected to form a RS latch. The output of gate 188 is connected to the first input of gate 190. The output of gate 190 is connected to a first input of gate 192. The second input of gate 192 is connected to node 130. The output of gate 192 is connected as the second input to gate 190.

The output of gate 192 is further connected through a node 193 as a first input to a NOR gate 194. The output of NOR gate 194 is connected to the cathode terminal of zener diode 180.

The delay circuit 100 includes counter circuits 196 and 198. Counter 196 is preferably a Model 4020 counter manufactured by Texas Instruments. Counter 198 is preferably a Model 4024 manufactured by Texas Instruments. The pin connections shown in FIG. 3 for counters 196 and 198 correspond to these listed products. The output of the gate 192 at line 193 is connected to the reset terminals of counters 196 and 198. The power terminal VDD is connected to pin 16 of counter 196 and to pin 14 of counter 198. The circuit ground is connected to pin 6 of counter 196 and pin 7 of counter 198. The Q13 output of counter 196 is connected through a switch 200 to the input terminal of counter 198. A switch 202 is connected between the Q14 output of counter 196 and the input to counter 198.

An oscillator circuit 208 produces a reference clock signal which is provided to the input terminal of counter 196. Oscillator 208 includes a capacitor 210 which is connected between a node 212 and the circuit ground. A crystal 214 is connected between node 212 and the first terminal of the capacitor 216. The second terminal of capacitor 216 is connected to the circuit ground. A resistor 218 is connected between node 212 and a node 220. A resistor 219 is connected between capacitor 216 and node 220. The node 220 is connected to provide the reference clock signal to the input of counter 196.

A resistor 226 is connected between the power node VDD and the drain terminal of an FET transistor 228. The gate terminal of transistor 228 is connected to node 212. The source terminal of transistor 228 is connected to node 220. An FET transistor 230 has the gate terminal connected to node 212, the drain terminal connected to node 220 and the source terminal connected to the first terminal of a resistor 232. The second terminal of resistor 232 is connected to the circuit ground.

The counter 198 utilizes five outputs which are labeled Ql, Q2, Q3, Q4 and Q5. Each of these outputs is connected to a respective input of NOR gates 234, 236, 238, 240 and 242.

A group of switches 244, 246, 248, 250 and 252 each have the switch arms thereof connected to the circuit ground. The switches 244, 246, 248, 250 and 252 are connectable respectively to nodes 254, 256, 258, 260 and 262. Resistors 264, 266, 268, 270 and 272 each have a first terminal connected to the power node VDD and have second terminals respectively connected to nodes 254, 256, 258, 260 and 262. The second inputs of each of the NOR gates 234, 236, 238, 240 and 242 are connected respectively to the nodes 254, 256, 258, 260 and 262. The outputs of NOR gates 234, 236, 238, 240 and 242 are connected as inputs to the NOR gate 194.

Figure 4:
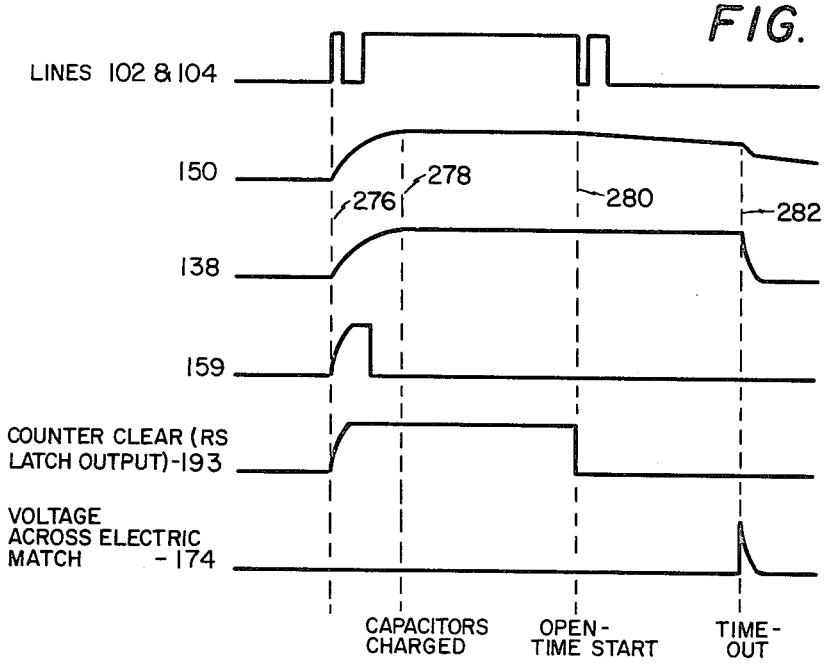
FIG. 4 is an illustration of waveforms for the circuit shown in FIG. 3.

The waveforms for signals which occur in the circuit 100 in FIG. 3 are illustrated in FIG. 4. These waveforms include the input signal across lines 102 and 104, the voltages across capacitors 140 and 152 at nodes 138 and 150, the signal at nodes 159 and 193 for the RS latch and the signal applied to the electric match 174. The time sequence of events are related by dashed lines 276, 278, 280 and 282.

The operation of the third embodiment of the present invention is now described in reference to FIGS. 3 and 4. The input signal is applied between lines 102 and 104 for a time period sufficient to charge the capacitors 140 and 152. The input signal should remain for at least three time constants to ensure that the capacitors are fully charged. The capacitor 140 is primarily utilized to supply a charge to ignite the electric match 174. The capacitor 152 is primarily utilized as a power source for the logic circuitry. The logic circuitry, which performs the timing function, is preferably fabricated in complementary metal oxide semiconductor (CMOS) technology to have a minimum power consumption.

As the capacitor 152 is charged by the DC voltage at nodes 116 and 118 produced by the input signal, the voltage at node 150 rises. The initiation of the input signal is shown by line 276. The voltage level at node VDD is regulated by zener diode 168 together with transistors 170 and 172. The zener diode 168 preferably has a breakdown voltage of 6.2 volts to regulate the voltage at the power node VDD to approximately 5.0 volts. This assumes a $V_{BE}$ of 0.6 volts for each of the transistors 170 and 172.

All of the logic gates, field effect transistors and counters in circuit 100 are powered by the voltage produced at the VDD node. As the voltage at the VDD is rising, the output of NOR gate 194 will have an indeterminate state. However, the zener diode 180 blocks the output of NOR gate 194 to prevent triggering the SCR 176 before VDD reaches a full level of 5.0 volts.

As soon as the voltage at node 116 exceeds the base-to-emitter voltage of transistor 128, node 130 is pulled to a low voltage state.

The impedance of resistor 154 is made approximately fifty times that of resistor 156 such that node 159 is maintained at a high voltage state until node 150 reaches approximately 25 volts. As the voltage at node 150 exceeds 25 volts, transistor 158 is turned on, thereby pulling the voltage at node 159 down to a low state. This delayed action, which is dependent upon a high charge state across the capacitor 152, serves as a reset to initialize the digital counting circuitry. This is shown as the pulse at node 159 in FIG. 4.

When the high level pulse at node 159 is propagated through inverter 186 and gate 188 to the RS latch comprising gates 190 and 192, node 193, which is the output of the latch, is driven to a high state to reset both of the counters 196 and 198. The high state at node 193 also keeps the output of gate 194 low.

As long as the input signal is maintained at a high voltage state, node 116 keeps transistor 128 turned on which maintains node 130 at a low voltage state. When the input signal is terminated, as indicated at line 280 in FIG. 4, transistor 128 is turned off, thereby pulling node 130 to a high voltage state to generate an initiating signal to start the counters 196 and 192. This transition at node 130 causes the state of the RS latch, comprising gates 190 and 192, to switch thereby driving node 193 to a low voltage state to remove the reset signal from the counters 196 and 198 which allows the counters to begin counting the input pulses received from the oscillator 208.

The time interval of the count is determined by the setting of switches 200, 202, 244, 246, 248, 250 and 252. The switches 200 and 202 are a range select to broadly determine the time interval. The setting of switches 244, 246, 248, 250 and 252 determines the precise duration of the delay interval period. This setting is also termed the digital reference count. The output terminals Q1, Q2, Q3, Q4 and Q5 of counter 198 transistion from a low to a high voltage state when the count for that terminal is reached. When any one of the five switches 244, 246, 248, 250 and 252 is open, the output of the corresponding NOR gate 234, 236, 238, 240 and 242 is driven low, thereby ignoring the output of the counter for that particular NOR gate. When all of the outputs of the NOR gates 234, 236, 238, 240 and 242 have gone to a low voltage state, the NOR gate 194 produces a high voltage state, an ignition signal, which triggers the SCR 176. When SCR 176 is triggered, the voltage stored on capacitor 140 is applied across the electric match 174 to cause the firing of the match. The voltage across the electric match 174 is shown in FIG. 4. The firing of the electric match serves to ignite an explosive charge (not shown).

Note that the time delay is the time period between the vertical lines 280 and 282. This time delay, time out, is determined by the setting of the switches noted above. Further, note that the count has started at the first negative transistion of the input signal applied to lines 102 and 104. After this first negative transistion the count cannot be terminated by restoring the input voltage.

In a preferred embodiment, the oscillator 208 is set at a frequency of 433 Khz. This provides a time delay in a range of from 0 to approximately 600 milliseconds for the described embodiment. Since the time interval is based upon the oscillation rate produced by the crystal 214, the period of the time delay can be set very accurately.

The circuits of the present invention offer numerous advantages including:

(a) The accuracy and precision of the timing of the electronic delay blasting cap is far superior to presently available pyrotechnic delays.

(b) The use of electronic delay blasting caps enables much better control over ground vibrations produced in multiple charge blasting operations by accurately controlling the time intervals between detonations.

(c) The use of electronic delay blasting caps gives blasting operators greater flexibility by permitting the use of more individual charges. This can be accomplished because the detonation can be controlled with greater precision and accuracy, thereby presenting the possibility of reducing the time intervals between detonations.

(d) The use of electronic delay blasting caps improves blasting results by eliminating out-of-sequence detonations.

(e) The combination of the electronic delay blasting cap and the sequential switch gives a more complete blast initiation system to delay times controlled completely be electronic means rather than by a combination of electronic (sequential switch) and pyrotechnic means.

The electronic delay blasting circuits of the present invention provide more reliability in blasting operations for the following reasons:

(a) All of the caps are armed prior to the detonation of any blast hole.

(b) The caps can be activated from a low voltage power source, thereby eliminating the shock hazard to blasting personnel and reducing the possibility of current leakage.

(c) All of the caps are connected in parallel which eliminates the need for energy calculations, thus, providing a blasting system that is more simple than conventional electric blasting systems.

The electronic delay blasting circuits of the present invention also provide a greater safety margin over conventional electric blasting caps for the following reasons:

(a) The blasting circuits of the present invention require higher voltage levels for initiation.

(b) The resistance to static electricity is improved with the control circuit components.

(c) The need for energy calculations is eliminated thus reducing the possibility of misfires.

A further advantage of the circuits of the present invention is that the time delay for the electronic delay blasting cap can be measured accurately during production to allow stamping of the actual delay time on the cap prior to field use. This assures that a correct time delay cap is used in a given operation.

Although several embodiments of the invention have been illustrated in the accompanying drawings and described in the foregoing detailed description, it will be understood that the invention is not limited to the embodiments disclosed, but is capable of numerous rearrangements, modifications and substitutions without departing from the scope of the invention.

I claim:

1. A circuit for firing an ignition element following a time delay, comprising:

means for storing an electrical charge, means for receiving an input signal to provide electrical energy therefrom to said means for storing, means for storing a digital reference count to determine the duration of said time delay, means responsive to an amplitude transition of said input signal for generating an initiating signal, digital timing means connected to receive said digital reference count and said initiating signal for generating an ignition signal at the expiration of the period of said time delay following receipt of said initiating signal, and means responsive to said ignition signal for connecting said means for storing an electrical charge to said ignition element for firing said ignition element.

2. A circuit for firing an ignition element following a delay period, comprising:

means for storing an electrical charge, means for receiving an input signal to provide electrical energy therefrom to said means for storing, means for storing a digital reference count to determine the duration of said time delay, an oscillator for generating a reference clock signal, counting means connected to receive said reference clock signal and produce therefrom a sequential count, means responsive to an amplitude transition of said input signal for initiating said counting means, means for comparing said digital reference count and said sequential count to produce an ignition signal, and means responsive to said ignition signal for connecting said means for storing an electrical charge to said ignition element for firing said ignition element.

* * * * *